United States Patent [19]

Wendt

[11] 4,154,035

[45] May 15, 1979

[54] CEILING RUNNER ATTACHMENT SYSTEM AND CLIP THEREFOR

[75] Inventor: Alan C. Wendt, Barrington, Ill.

[73] Assignee: United States Gypsum Company, Chicago, Ill.

[21] Appl. No.: 824,756

[22] Filed: Aug. 15, 1977

[51] Int. Cl.[2] ..... E04B 2/76; F24F 13/06

[52] U.S. Cl. ..... 52/238; 98/40 D

[58] Field of Search ..... 98/40 D, 40 DL, 29; 52/238, 241, 714; 248/228; 403/189, 190, 232.1

[56] References Cited

U.S. PATENT DOCUMENTS

| | | | |
|---|---|---|---|
| 3,307,315 | 3/1967 | Schneller | 52/238 |
| 4,073,108 | 2/1978 | Williams | 52/238 |

*Primary Examiner*—John E. Murtagh

*Attorney, Agent, or Firm*—Glenn W. Ohlson; Samuel Kurlandsky; Robert H. Robinson

[57] ABSTRACT

An atachment system, and attachment clip therefor, is disclosed for attaching panel engaging ceiling runners, positioned either parallel or perpendicular, to air distribution bar structures and inverted-T runner ceiling supporting structures.

27 Claims, 6 Drawing Figures

CEILING RUNNER ATTACHMENT SYSTEM AND CLIP THEREFOR

BACKGROUND OF THE INVENTION (1) Field of the Invention

The present invention relates to a ceiling runner attachment system in which an attachment clip is provided that is engageable with either air distribution bars or inverted-T runners thereby providing attachment means for ceiling runners positioned either parallel the supporting structure or perpendicular to the supporting structure.

(2) Description of the Prior Art

It is desirable to provide an interface connection between panel engaging ceiling runners and ceiling support structures that will provide acoustical and structural integrity. It is particularly desirable for such connections to be adaptable when wall panels, or partitions, are installed parallel or transverse to air distribution bars or, parallel or transverse to conventional T grids. Similarly, in combination support structure systems where air distribution bars comprise a portion of the ceiling structure and conventional inverted-T runners comprise the remaining portions of the ceiling structures, it is also desirable to provide attachment means adaptable to such combination wherein wall panels, or partitions, may be positioned parallel or transverse to said supporting ceiling structures.

Attachment runner systems have been constructed in the past. One such attempt is shown in U.S. Pat. No. 3,003,735, to Havener, which provides an attachment clip for attachment to ceiling T grids above and attachment to partition ceiling runners along the underneath side of the clip. Problems still remain unsolved. While this clip is designed to provide attachment to ceiling T grids without defacing the exposed grid flange with screw holes or the like, the rotating snap-on engagement severely scratches the grid flange none the less. Bolting is required to secure partition ceiling runners to the clip and a gap is left between the ceiling runner and T grid as a result of the combined thickness of the clip and fastener means. Moreover, an additional problem is confronted in that partition ceiling runners installed perpendicular to the ceiling T grid provide less lateral resistance to loads than those installed parallel the ceiling T grid because the clip has a tendency to slide in that direction. Lastly, in combination grid systems wherein the supporting structures comprise both air distribution bars and inverted-T runners, a different attachment clip would be required for engagement with engageable flanges located on conventional air distribution bars.

In another ceiling runner attachment system a steel bar portion is twist-engaged to a ceiling grid. A second member, being a metal pan with legs extending upwardly, is snapped-on to engage the bar member and provide a space between the pan and the bar for the insertion of acoustical material. A partition ceiling runner is then fastened, by screws or the like, to the underside of the pan member. This clip structure is adaptable to use with air distribution bars, as well as conventional T grid systems, since a gap is provided between the pan and bar members to permit air flow therethrough. However, certain disadvantages entail the use of this attachment system. The pan member provides an unsightly appearance from below. Again, as with previous systems, the twist-engaging attachment of the bar members scratches and mars the ceiling grid system support members. The pan member, being of sheet metal construction, lacks rigidity and is susceptible to flexing. Finally, with transverse partition alignments, sufficient resistance to lateral loading cannot be accomplished unless the bar member is fastened by screws or the like to the ceiling grid after the initial twist engagement.

Other attachment systems have been utilized for ceiling runner attachment systems. No systems in the part have been able to overcome the obstacles created in trying to obtain an acoustical ceiling having a recessed ceiling system that provides a shadow line effect wherein no marring of the grid support member occurs during installation and wherein exposed flanges of support structures remain free from screw holes, or the like, for fastening means. In addition to these basic problems, unsolved in the past, a further problem, that stood unsolved, was the inability of previous systems to provide an attachment system that would accommodate a ceiling support structure comprising both air distribution bars and conventional inverted-T runners wherein demountable partition assemblies were desired that kept the exposed portions of ceiling structures undamaged during installation and after removal. Along with the foregoing, an obstacle is presnted in attempting to solve the attachment difficulties without restricting air flow in systems incorporating air distribution bars. It has furthermore been desirable for such a system to also provide a means for ceiling runners, engaged to wall panels or partitions, to be located either parallel or perpendicular to such ceiling structure support members. Prior structures have not solved these numerous attendant problems which arise in attempting to provide this long desired ceiling runner attachment system. The new and useful ceiling runner attachment system of this invention overcomes all of the deficiencies associated with prior systems.

SUMMARY OF THE INVENTION

It is therefore an important object of this invention to provide a ceiling runner attachment system that provides structural and acoustical integrity when partitions are installed parallel or perpendicular to air distribution bars, or parallel or transverse to conventional inverted-T runner grid members, or parallel or transverse to conventional inverted-T runner grid systems with air distribution bars positioned along portions of inverted-T runners.

An accordingly critical objective of this invention is to provide an attachment system, incorporating air distribution bars, that does not restrict air flow.

It is an additional object of this invention to provide an attachment clip for connecting ceiling runners to air distribution bars when positioned either parallel or perpendicular to the air distribution bars.

It is another object of this invention to provide an attachment clip for the connection of ceiling runners to inverted-T runners when positioned either parallel or perpendicular to said inverted-T runners.

It is yet another object of this invention to provide a ceiling runner system which provides sound attenuation properties along the connection between the ceiling runner and ceiling support member.

It is still further another object of this invention to provide a ceiling runner attachment system which is demountable.

It is still another object of this invention to provide for demountability of ceiling runners without defacement or marring of exposed portions of ceiling support structures.

It is yet another object of this invention to provide a ceiling runner attachment system, and attachment clip therefor, in which the attachment clip is usable for the attachment of a ceiling runner to either an air distribution bar or a conventional inverted-T runner thereby providing a system with the economy and practicability of interchangeable components.

Other objects and advantages will become apparent upon reference to the drawings and detailed description.

The objects of this invention are accomplished by an attachment clip securing panel engaging ceiling runners, or the like, to supporting structures, said clip having integral construction comprising: a securing plate; a bearing seat extending outwardly from the lower edge of the securing plate at a generally perpendicular direction; a leg portion extending downwardly from the bearing seat along the edge opposing the securing plate; a bottom plate extending inwardly from the leg portion along the edge opposing the bearing seat in a plane substantially parallel to the bearing seat; and, two bracing tabs, one each extending inwardly from the leg portion along a portion of the length of opposing side edges and both extending at generally right angles to the plane of the securing plate.

In further accomplishing the objects of this invention, another embodiment of this invention provides that the leg portion of the attachment clip extend downwardly and outwardly from the bearing seat at an oblique angle.

In another embodiment of this invention, the objectives are further attained by an attachment clip wherein the securing plate, bearing seat, leg portion and bottom plate all have generally rectangular configuration.

The objects of this invention are further attained in providing an attachment clip wherein the bracing tabs have a generally trapezoidal configuration and extend inwardly from the leg portion generally perpendicular to the plane of the securing plate terminating short of that plane, and wherein the bracing tabs extend along the side edges of the leg portion from the bottom of the side edge upwardly but terminating sufficiently short of the bearing seat to thereby provide a space between the top edges of the bracing tabs and the bearing seat for the engagement of flanges extending from support members such as the arms of conventional inverted-T runners and the longitudinal flanges of conventional air distribution bars.

Additional important objects of this invention are accomplished in providing a ceiling runner system which comprises: an inverted-T runner ceiling grid; an air distribution bar positioned along at least one inverted-T runner and having longitudinal flange portions extending outwardly from side walls of the air distribution bar; a plurality of attachment clips secured to said air distribution bar; at least one ceiling panel having an edge supportingly resting upon the flange portion of the air distribution bar, at least one ceiling runner located either parallel or perpendicular to the air distribution bar comprising a top plate and depending flange members wherein the top plate is attached to at least one attachment clip by fastening means; and, at least one wall panel having a top edge engaged to a flange member of the ceiling runner. Additionally, in attaining the objectives of this invention, acoustical sound barrier material is provided between, and contacting both, the ceiling runner and bottom of the inverted-T runner.

The objects of this invention are additionally accomplished by providing a ceiling runner system which comprises: an inverted-T runner ceiling grid; a plurality of attachment clips secured to the web of an inverted-T runner by fastening means and supportingly engaged by the arms of the inverted-T runners; at least one ceiling panel having an edge supportingly resting upon the arm of an inverted-T runner; at least one ceiling runner located either parallel or perpendicular to an inverted-T runner comprising a top plate and depending flange members wherein the top plate is attached by fastening means to at least one attachment clip; and, at least one wall panel having a top edge engaged to a flange member of a ceiling runner. In further accomplishing the objectives of this invention, acoustical sound barrier material is provided between, and contacting both, the ceiling runner and bottom of the inverted-T runner.

It is thus seen that the new and useful ceiling runner attachment system, and clip therefor, overcome the deficiencies and problems contained in the prior art. Other objects and advantages of this invention will become apparent upon reference to the following description of the drawings and preferred embodiments.

DESCRIPTION OF THE PREFERRED EMBODIMENTS

This invention may be more fully described, but is not limited, by reference to the attached drawings and following discussion of the preferred embodiments discussed hereinafter.

Figure 1:
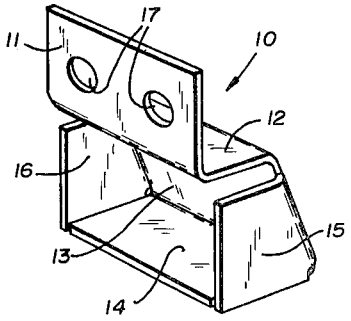
FIG. 1 is a perspective view of the attachment clip according to the invention.

FIG. 1 shows the preferred embodiment of the attachment clip 10 in perspective view. Securing plate 11 is generally vertically disposed and provided with screw holes 17 for attachment to a supporting structure. Extending outwardly from the lower edge of securing plate 11 is bearing seat 12 upon which edges of ceiling tile supportingly rest when the clip 10 is attached to a supporting structure in the ceiling runner attachment system according to this invention. At the opposite edge of bearing seat 12, leg portion 13 depends downwardly and outwardly at an oblique angle terminating at the other end in a bottom plate 14 extending inwardly therefrom in a plane generally parallel to the plane of bearing seat 12. From opposing sides of leg portion 13, bracing tabs 15 and 16 extend inwardly at generally right angles to the plane of securing plate 11. In the preferred embodiment bracing tabs 15 and 16 have generally trapezoidal configuration; also, securing plate 11, bearing seat 12, leg portion 13 and bottom plate 14 all have generally rectangular configuration.

Figure 2:
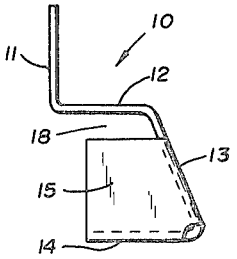
FIG. 2 is a side view of the attachment clip shown in FIG. 1.

FIG. 2 is a side view of attachment clip 10 as shown in FIG. 1. In this embodiment of the invention bracing tabs 15 and 16 extend from the bottom end of the side edges of leg portion 13 for substantially the entire length of the side edges but stop short of bearing seat 12 thereby providing a space 18 into which a flange portion, or the like, of a supporting structure may be supportingly engaged by attachment clip 10. It is further seen, in this embodiment of the invention, that the bracing tabs 15 and 16 extend inwardly from leg portion 13 at generally right angles to the plane of securing plate 11 but terminate short of this plane. Further, in this embodiment, the bottom edges of bracing tabs 15 and 16 are coplanar with the bottom plate 14.

Figure 3:
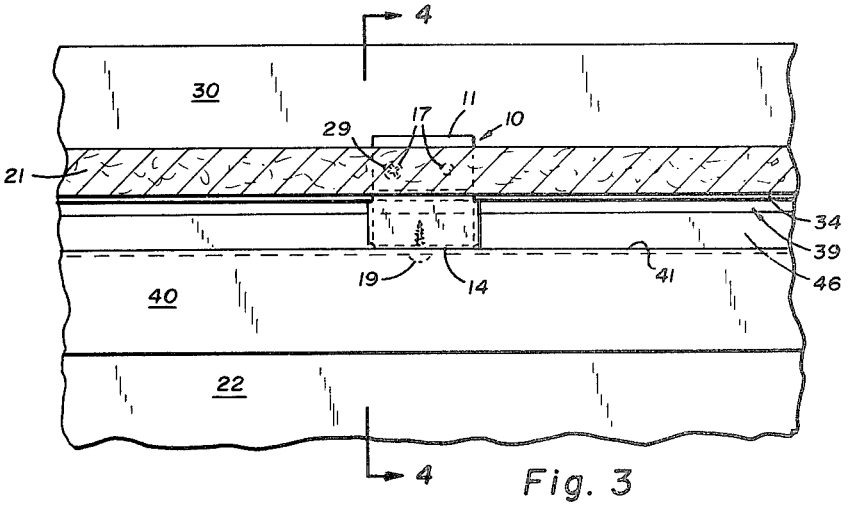
FIG. 3 is a side view of the ceiling runner attachment system according to the invention incorporating an air distribution bar and ceiling runner in parallel relationship.
Figure 4:
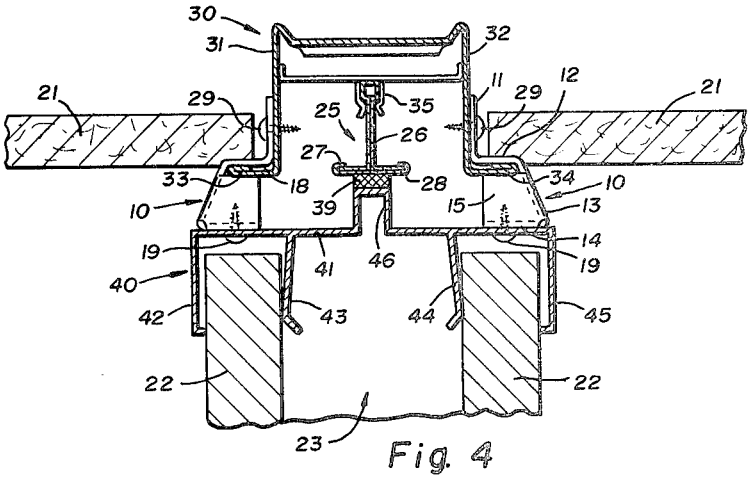
FIG. 4 is a sectional view taken along line 4—4 of FIG. 3 in the direction of the arrows, showing the ceiling runner attachment system incorporating an air distribution bar in parallel relationship to a ceiling runner.
Figure 5:
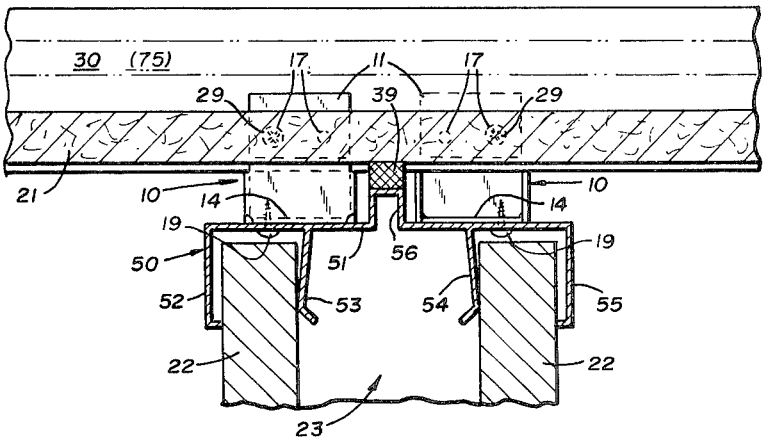
FIG. 5 is a sectional view of a ceiling runner according to the invention, positioned perpendicular to an air distribution bar, and alternatively, perpendicular to an inverted-T runner, shown in phantom.
Figure 6:
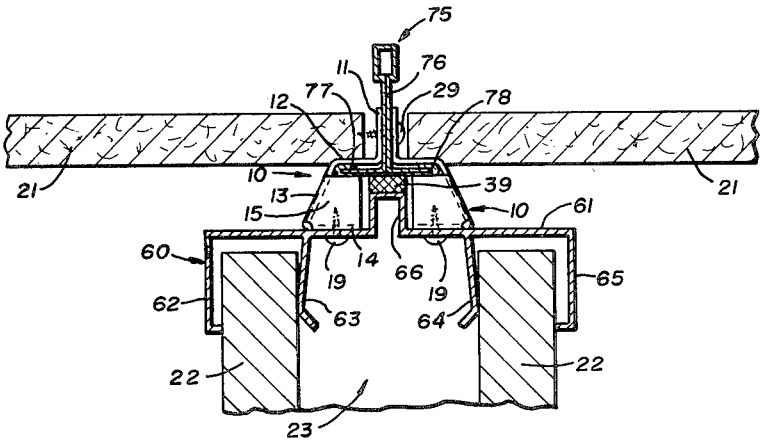
FIG. 6 is a sectional view of the ceiling runner attachment system, according to the invention, showing the ceiling runner attached to an inverted-T runner in a parallel relationship.

In FIGS. 3–6, four orientations of the ceiling runner attachment system according to the invention are shown. FIGS. 3 and 4 depict a ceiling runner parallel to an air distribution bar with an inverted-T runner supportingly engaged within the air distribution bar. FIG. 5 illustrates the ceiling runner connecting perpendicular to an air distribution bar. FIG. 5 also shows, in phantom, the substantially similar attachment situation of a ceiling runner connecting perpendicular to an inverted-T runner alone. FIG. 6 shows a ceiling runner parallel with, and connecting to, an inverted-T runner, thus illustrating the fourth of four typical orientations provided by the ceiling runner attachment system of this invention.

Referring now more specifically to FIGS. 3 and 4, an air distribution bar 30 is positioned along a supportingly engaged inverted-T runner 25 with attachment clips 10 secured and supportingly engaged to the air distribution bar 30 and securing ceiling runner 40 below. Air distribution bar 30 has side walls 31 and 32 respectively having longitudinal flanges 33 and 34 extending outwardly therefrom. Attachment clips 10 are secured by means of self-tapping screws 29 inserted through screw holes 17 of securing plates 11 and engaging side walls 31 and 32 of air distribution bar 30. Flanges 33 and 34 are positioned within spaces 18 to supportingly engage attachment clips 10. The edges of ceiling tile 21 supportingly rest along the upper side of longitudinal flanges 33 and 34; and, at attachment clip 10 locations, the ceiling tile supportingly rest on bearing seats 12 as shown in FIG. 4. Supportingly engaged within the conventional air distribution bar 30 is conventional inverted-T runner 25. Inverted-T runner 25 comprises web portion 26 and opposing arms 27 and 28 extending outwardly from the lower end of the web portion 26 thereby comprising the cross portion of the "T". Supporting means 35, being a clip or the like, depends inside air distribution bar 30 and supportingly engages inverted-T runner 25. Ceiling runner 40 is located in parallel orientation with air distribution bar 30. A top plate 41 communicates with bottom plate 14 of attachment clips 10 and is fastened thereto by self-tapping screw 19 extending upwardly through top plate 41 then into and through bottom plate 14 of attachment clips 10. In the preferred embodiment one self-tapping screw 19 provided for each attachment clip 10 is sufficient for proper securement of top plate 41 to bottom plate 14. Along with having top plate 41, ceiling runner 40 comprises two pairs of flanges depending from said top plate 41, these being flanges 42, 43, 44 and 45. Between opposing pairs of flanges, conventional wall panels 22 have top edges disposed therebetween. Thus, as shown in FIG. 4, a double row panel alignment is contemplated in the preferred embodiment having a wall cavity 23 between opposing spaced-apart rows of wall panels 22. Centrally located on top plate 41, and extending upwardly therefrom, raised rib 46 extends longitudinally along substantially the full length of ceiling runner 40. Raised rib 46 provides increased strength for ceiling runner 40 and added sound attentuation. Between the bottom of inverted-T runner 25 and the top of raised rib 46 acoustical sound barrier material 39 is positioned along substantially the full length of ceiling runner 40. Acoustical sound barrier material 39 preferably comprises an acoustical closed-cell foam. Acoustical sound barrier material 39 inhibits the transmission of sound over wall panels 22 and ceiling runner 40, thus attaining a desirable objective of this invention.

The ceiling runner attachment system shown in FIGS. 3 and 4 provide desirable structural stability, acoustical integrity, and unrestricted air distribution flow to either side of a wall partition along which an air distribution bar, of conventional structure, is located. It is illustrated in FIG. 4 that by providing an oblique downwardly extending leg portion 13 of attachment clip 10, bottom plate 14 has a greater engageable surface area for engagement with top plate 41 of ceiling runner 40 by means of self-tapping screws 19. Bracing tabs 15 of attachment clip 10 provide rigidity and stability by preventing bending along the upper and lower edges of leg portion 13. The air flow passing downward through air distribution bar 30 is bifurcated due to the arrangement of inverted-T runner 25, acoustical sound barrier material 39, and raised rib 46. In this preferred configuration, the air flow is thereby split and flows unrestricted over either side of ceiling runner 40. It is shown in FIG. 3 that for an attachment clip 10 a single self-tapping screw 29 is sufficient for securement of securing plate 11 to the side wall 32. It is also to be noted that in the preferred embodiment attachment clips 10 need not be positioned directly opposite one another on the air distribution bar 30 as shown in FIG. 4. They may be staggered along either side of the air distribution bar 30 as attachment requirements dictate.

Referring now to FIG. 5, it is seen that a side view of an air distribution bar 30 is depicted with a transverse sectional view of a ceiling runner 50. Also, shown in phantom, a pictorially similar attachment is depicted with a side view of inverted-T number 75 likewise connected to transversely positioned ceiling runner 50. In this embodiment, the objective of providing a ceiling runner attachment system wherein ceiling runners can connect perpendicular to air distribution bars and inverted-T runners is obtained. This conformation shows attachment clips 10 engaging air distribution bar 30 as in FIG. 4, but here the securement of ceiling runner 50 is now transverse rather than parallel to air distribution bar 30. In this preferred embodiment, ceiling runner 50 comprises raised rib 56 extending upward from the center of top plate 51. From top plate 51 two pairs of flanges downwardly extend, these being flanges 52, 53, 54 and 55. Between flanges of opposing pairs of flanges 52–53 and 54–55, the top edges of conventional wall panels 22 are therebetween positioned and thereby define a wall cavity 23 therebetween. Extending for the substantially the full length of ceiling runner 50, and being located between the top side of raised rib 56 and bottom of longitudinal flanges 33 and 34, acoustical sound barrier material 39 is positioned, thus providing attenuation of sound transmission over ceiling runner 50. Of course, along lengths of the ceiling runner away from intersections with air distribution bars, the acoustical sound barrier material contacts the bottom side of ceiling tile 21. In the preferred embodiment shown in FIG. 5, two attachment clips 10 are staggered along either side of air distribution bar 30 and located on either side of raised rib 56 of transversely positioned ceiling runner 50. However, depending on the needs of the particular construction, one, two, three or four attachment clips 10 may be provided, since with four quadrants, four possible positions for attachment are created by this intersection, as shown in FIG. 5. Also, a single self-trapping screw 19 and single self-tapping screw 29 are sufficient for securing each attachment clip 10 in this preferred embodiment. Additional self-tapping screws 19 and 29 may be provided for an attachment clip 10 as particular needs may require.

FIG. 6 shows the preferred embodiment of the ceiling runner attachment system of this invention wherein a ceiling runner 60 is in parallel alignment with an inverted-T runner 75. Inverted-T runner 75 is a conventional runner in ceiling grid system construction, having web portion 76 and arms 77 and 78 extending outwardly from the lower end of web 76 thereby defining the cross portion of the "T". In the preferred embodiment, attachment clips 10 are positioned on opposite sides of inverted-T runner 75 such that a single self-tapping screw 29 attaches opposing securing plates 11 of both attachment clips 10 through corresponding screw holes 17 with web portion 76 supportingly engaged therebetween. Upon upper sides of bearing seats 12, and upon upper sides of arms 77 and 78, conventional ceiling tile 21 have their edges supportingly resting. Ceiling runner 60 comprises top plates 61 having two pairs of flanges 62–63 and 64–65 depending downwardly therefrom. Extending upwardly from top plate 61 is raised rib 66 extending longitudinally and being centered along ceiling runner 60. The upper surface of top plate 61 communicates with the bottom of bottom plates 14 of attachment clips 10. Self-tapping screws 19 are screwed upwardly through top plate 61 to engage bottom plate 14. In the preferred embodiment, a single self-tapping screw 19 is sufficient for each individual attachment clip 10. Positioned between, and contacting both, raised rib 66 and inverted-T runner 75, acoustical sound barrier material 39 extends for substantially the full length of ceiling runner 60 thereby providing a means for inhibiting sound transmission over the tops of ceiling runner 60 and wall panels 22. Bracing tabs 15 provide needed lateral and longitudinal rigidity to attachment clips 10 for attachment with ceiling runner 60.

The orientation wherein a ceiling runner is positioned perpendicular to an inverted-T runner is depicted with phantom line inverted-T runner 75 in FIG. 5. Both the orientation and connection of a transverse ceiling runner in the inverted-T runner situation and in the air distribution bar situation are clearly represented with reference to FIG. 5. In this preferred embodiment, two attachment clips 10 are staggered on either side of inverted-T runner 75 in a ceiling grid system. In FIG. 5. the orientation, as compared with that of FIG. 6, shows that the attachment clips 10 connect to inverted-T runner 75 in the identical manner. In this preferred embodiment, an attachment clip 10 is located on either side of raised rib 56 and a single self-tapping screw 19 is sufficient for each attachment clip 10 for the connection through top plate 51 with bottom plates 14. At this intersection, acoustical sound barrier material 39 is positioned along the top of raised rib 56 and contacts the bottom side of inverted-T runner 25. As discussed above, regarding the perpendicular intersection of the ceiling runner 50 with air distribution bar 30, one, two, three or four attachment clips can be provided at this intersection as required.

In the preferred embodiments of this invention, as described herein, an esthetic connection is provided for a ceiling runner to either an air distribution bar of conventional design or an inverted-T runner of conventional design. The ceiling runner attachment system in the preferred embodiments is adaptable to combinations of air distribution bar members with inverted-T runner members. In using the attachment clip as provided herein, the benefits associated with consistency of appearance is maintained, and structural and acoustical integrity is provided.

Although shown in the preferred embodiments to have four depending flanges, many types of ceiling runner configurations are operable with the ceiling runner attachment system of this invention. For example, flanges 43 and 44 of ceiling runner 40 shown in FIG. 4 could be removed and wall panels 25 engaged to the inside or outside vertical surfaces of remaining flanges 42 and 45 to provide yet another embodiment within the scope of the invention. Likewise, the number of attachment clips used in a ceiling runner attachment system is not to be considered limited by the drawings and discussion of the preferred embodiments, since enumerable locations and combinations of clips along ceiling supporting structures are possible as requirements of strength, stability, esthetics, and the like, will vary.

In the preferred embodiments of this invention, self-tapping screws 19 and 29 are to be considered as also having self-drilling properties. It is intended that other operable fastening means are includable within the scope of this invention.

Further embodiments of this invention will become apparent to those skilled in the art. The ceiling runner attachment system, and clip therefor, is not intended to be limited by the drawings, and equivalent embodiments of this invention are intended to be accordingly considered within the purview of the invention herein.

What is claimed is:

1. An attachment clip for securing panel engaging ceiling runners of the like to supporting structures, said clip having integral construction comprising:

a securing plate;

a bearing seat extending outwardly from the lower edge of the securing plate at a generally perpendicular direction;

a leg portion extending downwardly from the bearing seat along the edge opposing the securing plate;

a bottom plate extending inwardly from the leg portion along the edge opposing the leg portion in a plane substantially parallel to the bearing seat;

two bracing tabs, one each extending inwardly from the leg portion along a portion of the length of opposing side edges and both extending a generally right angles to the plane of the securing plate.

2. An attachment clip as in claim 1, wherein the securing plate is provided with screw holes for insertion of fastening means to secure said clip to a supporting structure.

3. An attachment clip as in claim 1, wherein the securing plate, bearing seat, leg portion and bottom plate have generally rectangular configuration.

4. An attachment clip as in claim 3, wherein the longitudinal axes of the securing plate, bearing seat, leg portion and bottom plate are substantially parallel.

5. An attachment clip as in claim 1, wherein the leg portion extends downwardly and outwardly from the bearing seat at an oblique angle.

6. An attachment clip as in claim 1, whereinthe bottom plate terminates short of the plane defined by the securing plate.

7. An attachment clip as in claim 5, wherein the botton plate terminates short of the plane defined by the securing plate.

8. An attachment plate as in claim 1, wherein the bracing tabs have a generally rectangular configuration.

9. An attachment clip as in claim 1, wherein the bracing tabs extend along the side edges of the leg portion from the bottom of the side edge upwardly but terminating sufficiently short of the bearing seat thereby providing a space between the top edges of the bracing tabs and the bearing seat for the engagement of flanges of support members.

10. An attachment clip as in claim 1, wherein the bracing tabs have a generally trapezoidal configuration.

11. An attachment as in claim 9, wherein the bracing tabs have a generally trapezoidal configuration.

12. An attachment clip as in claim 1, wherein the bracing tabs extend inwardly from the leg portion and terminate short of the plane defined by the securing plate.

13. An attachment clip as in claim 9, wherein the bracing tabs extend inwardly from the leg portion and terminate short of the plane defined by the securing plate.

14. An attachment clip as in claim 1, wherein the botton edges of the bracing tabs reside in coplanar relationship with the plane defined by the botton plate.

15. An attachment clip as in claim 9, wherein the botton edges of the bracing tabs residue in coplanar relationship with the plane defined by the bottom plate.

16. a ceiling runner system comprising:

an inverted-T runner ceiling grid;

an air distribution bar positioned along at least one inverted-T runner with said inverted-T runner supportingly engaged inside the air distribution bar, and having longitudinal flanged portions extending outwardly from side walls of the air distribution bar;

A plurality of attachment clips secured to said air distribution bar by fastener means and said clips being supportingly engaged by the longitudinal flanged portions of the air distribution bar;

at least one ceiling panel having an edge supportingly resting upon a flanged portion of the air distribution bar;

at least one ceiling runner located either parallel or perpendicular to the air distribution bar comprising a top plate and depending flange members wherein the top plate is attached to at least one attachment clip by fastening means;

at least one wall panel having a top edge engaged to a flange member of the ceiling runner.

17. A ceiling runner system as in claim 16, wherein a plurality of air distribution bars are positioned along a plurality of said inverted-T runners.

18. A ceiling runner system as in claim 17, wherein a plurality of ceiling runners are located parallel to the air distribution bars.

19. A ceiling runner system as in claim 17, wherein a plurality of ceiling runners are located perpendicular to the air distribution bars.

20. A ceiling runner system as in claim 17, wherein a plurality of ceiling runners are located parallel to the air distribution bars and a plurality of ceiling runners are located perpendicular to the air distribution bars.

21. A ceiling runner system as in claim 16, wherein the ceiling runner comprises a top plate having two pairs of depending flanges wherein two parallel spaced-apart rows of wall panels have top edges positioned between opposing pairs of said flanges thereby providing a wall cavity between said parallel rows of wall panels.

22. A ceiling runner system as in claim 16, wherein an attachment clip is provided for securing panel engaging ceiling runners or the like to supporting structures, said clip having integral construction comprising:

a securing plate;

a bearing seat extending outwardly from the lower edge of the securing plate at a generally perpendicular direction;

a leg portion extending downwardly from the bearing seat along the edge opposing the securing plate;

a bottom plate extending inwardly from the leg portion along the edge opposing the leg portion in a plane substantially parallel to the bearing seat;

two bracing tabs, one each extending inwardly from the leg portion along a portion of the length of opposing side edges and both extending at generally right angles to the plane of the securing plate.

23. An attachment clip as in claim 22, wherein the securing plate is provided with screw holes for insertion of fastening means securing said clip to the air distribution bar.

24. A ceiling runner system as in claim 16, wherein the ceiling runner comprises a longitudinal raised rib centered along the top plate.

25. A ceiling runner system as in claim 16, wherein acoustical sound barrier material is located between, and contacts both, the ceiling runner and bottom of the inverted-T runner.

26. A ceiling runner system as in claim 16, wherein the fastening means connecting the attachment clip and the ceiling runner is a self-drilling and self-tapping screw.

27. A ceiling runner system as in claim 16, wherein the fastening means connecting the attachment clip and the air distribution bar is a self-drilling and self-tapping screw.

* * * * *